US005295337A

United States Patent [19]

Massarsch

[11] Patent Number: 5,295,337

[45] Date of Patent: Mar. 22, 1994

[54] ISOLATION ELEMENT AND THE USE THEREOF AT AN ISOLATION ARRANGEMENT

[76] Inventor: Karl R. Massarsch, Ferievägen 25, S-161 51 Bromma, Sweden

[21] Appl. No.: 955,900

[22] PCT Filed: May 13, 1991

[86] PCT No.: PCT/SE91/00324

§ 371 Date: Dec. 10, 1992

§ 102(e) Date: Dec. 10, 1992

[87] PCT Pub. No.: WO91/19862

PCT Pub. Date: Dec. 26, 1991

[30] Foreign Application Priority Data

Jun. 12, 1990 [SE] Sweden ..... 9002095-9

[51] Int. Cl.[5] ..... E04B 1/92

[52] U.S. Cl. ..... 52/169.11; 52/167 R

[58] Field of Search ..... 52/169.11, 167 R, 167 RA, 52/167 E, 167 EA, 405, 406, 404

[56] References Cited

U.S. PATENT DOCUMENTS 4,335,548 6/1982 Rehbein ..... 52/169.11
4,647,258 3/1987 Massarsch ..... 52/167 R

FOREIGN PATENT DOCUMENTS 2043030 8/1970 Fed. Rep. of Germany ... 52/169.11
2574448 4/1986 France ..... 52/169.11

*Primary Examiner*—Carl D. Friedman
*Assistant Examiner*—Creighton Smith
*Attorney, Agent, or Firm*—Ware, Fressola, Van Der Sluys & Adolphson

[57] ABSTRACT

The present invention concerns an isolation element for the isolation of vibrations and/or heat, which propagate/s in a medium such as soil, as well as the application of isolation element in an isolation arrangement. The isolation element is characterized by a rectangular plate-shaped block (1) with one or several on one or both of the two side surfaces attached cushion-shaped bodies (2). The isolation arrangement is characterized by a trench (7) in the ground, in the bottom of the trench preferably vertically anchored guide rods (8) placed in a row, in the trench poured stabilizing slurry (10) as well as on the guide rods (8) threaded and from the bottom of the trench (7) to the orifice and preferably along the whole length of the trench on top of each other and/or next to each other stacked isolation elements (9) placed on their edges.

21 Claims, 4 Drawing Sheets

ISOLATION ELEMENT AND THE USE THEREOF AT AN ISOLATION ARRANGEMENT

BACKGROUND OF THE INVENTION

1. Field of the Invention

The invention concerns an isolation element for the isolation of vibrations and/or heat, which are propagated in a medium such as soil, as well as the application of such isolation elements in connection with vibration isolation measures.

2. Description of the State of the Art

Vibrations, which are generated in a medium such as soil or water, and which are propagated through this medium, can cause damage to structures, which are located on or in this medium. Vibrations can be generated by a variety of sources, for example by vehicles, machines, blasting or earthquakes. Many attempts have been made to eliminate the propagation of vibrations, in order to protect structures, machines or installations. As a result of such measures, as a secondary effect, it is also possible to isolate the propagation of heat.

Open trenches in the soil are effective measures to protect buildings and other structures in the ground against oscillations and vibrations. Another common method of vibration isolation is to arrange concrete or steel barriers in the ground. Their vibration efficiency, however, is significantly lower than that of open trenches. Swedish Patent Document No. SE, B, 430,620 shows a method for vibration isolation with the aid of one or several membranes, which are installed in the ground, and an arrangement for the implementation of this method. This method is characterized by a membrane or connected membranes. which contain a medium such as air, water or similar agents, and which are made of plastic or similar material, and which are installed in the ground vertically or inclined for instance by means of pressing, vibrating, driving, jetting or a combination of these methods, with the aim of absorbing the vibration energy and to reduce the oscillation energy. The membrane is provided at the upper end with a valve body, through which the pressure in the membrane can be varied before, during or after installation. The membrane can at the lower end be provided with a beam-like arrangement, which during the installation phase creates an opening in the soil of required width. The membrane or membranes can, for example, be installed using a fork-like tool. The described method is expensive and there exists a risk that one or several receptacles are damaged by a sharp article located in the ground.

Swedish Patent Document No. SE, B. 460.062 shows an arrangement for vibration isolation and/or heat isolation. The arrangement comprises membranes which can be installed in a medium such as soil or water. The membranes consist of a flexible, external, relatively stiff covering membrane, which is impermeable with respect to the mentioned medium, and at least one additional flexible inner membrane element consisting of a diffusion-tight material. The inner membrane surrounds a closed space consisting of p double-folded foil, which is welded together to form a receptacle and cells or channels filled with air, gas, liquid or foam or a combination thereof on the side surfaces of the receptacle. The cells or channels of one side of the foil are separated from the cells and channels of the other side of the foil, whereby one (or several) chambers are created between them which can either be filled with air, gas, liquid or foam.

A valve can be arranged at the inner membrane in order to make it possible to fill the space with an appropriate material and with desired pressure. The risk of puncturing of the multi-layered membrane is thereby reduced. Damage to one or several chambers do not affect the vibration isolation effectiveness of the membrane. The covering envelope is so stiff that it can distribute variations of the earth pressure. However, the above mentioned disadvantage of high installation cost remains.

In built-up areas, it is common to first excavate a trench in the ground, which is filled with a suitable stabilizing liquid in order to assure the stability of the trench during installation. For the installation of the above mentioned vibration isolation arrangement in a liquid-filled trench, the isolation elements must be provided with special anchors at the bottom of the excavated trench, as the buoyancy of the gas-filled cushions can be considerable. The anchoring can be provided by heavy concrete blocks which are attached in advance to the lower end of the cushions. Alternatively, the cushions can be connected to ground anchors which are installed at the bottom of the trench. The installation of concrete blocks requires the lifting of heavy loads. In addition, the trench must be excavated to greater depth in order to provide space for the anchoring weights. The isolation elements must be installed accurately in the trench in order to achieve a continuous isolation barrier. In practice, it can be difficult to place the flexible cushions with sufficient precision, in order to assure vertical and laterial continuity of the isolation barrier.

SUMMARY OF THE INVENTION

The present invention combines the vibration isolation effect of an open trench with that of a stiff wall, and offers in addition a solution to the above described installation problems. The invention comprises an isolation element in the shape of a generally rectangular, plate-shaped block with one or several cushion-shaped bodies attached to one of its two largest surfaces, i.e. the side surfaces. The block is made of a material with high density and high stiffness such as concrete, iron or steel. The cushion-shaped bodies can either be hollow or consist of plastic sheet material or other material with low density and low stiffness, such as styrofoam or plastic material. This material combination produces a high isolation effect, because it achieves a sharp change of the dynamic stiffness (impedance). The invention further comprises the use of isolation elements in an isolation arrangement for the isolation of vibrations and/or heat, preferably in soil or water. The isolation arrangement comprises a trench in the ground, and at the bottom of the trench, preferably vertically anchored guide rods which are placed in a row. The trench is filled with a stabilizing liquid and the isolation elements are inserted, one on top of the other and/or next to each other, on the guiding rods, from the bottom of the trench upwards and preferably in its whole longitudinal length. The elements are erected on the edge sides and can be connected with each other vertically and laterally with the aid of coupling arrangements similar to those of sheet pile locks or wedge locks.

The rectangular, plate-shaped isolation elements are manufactured in blocks consisting of a material with high density, preferably concrete, which makes it possible to place the elements simply and with great accuracy, without requiring any special anchoring weights at the lower end of the elements. The guide rods make it possible to construct large isolation barriers in a simple manner and with high precision. It is thus not necessary to excavate the trench deeper.

With the aid of the guide rods, it is possible to assemble the isolation elements in such a way that a stiff wall is created. If required, the guide rods can be pre-stressed, whereby a high strength is achieved in order to resist earth pressures or dynamic forces. The vertical wall can also be used to support horizontal isolation elements which are fixed to its upper end. Their function is to protect the isolation elements from e.g. traffic loads, infiltration of polluted substances or against temperature variations.

DETAILED DESCRIPTION OF THE PREFERRED EMBODIMENTS

Figure 1:
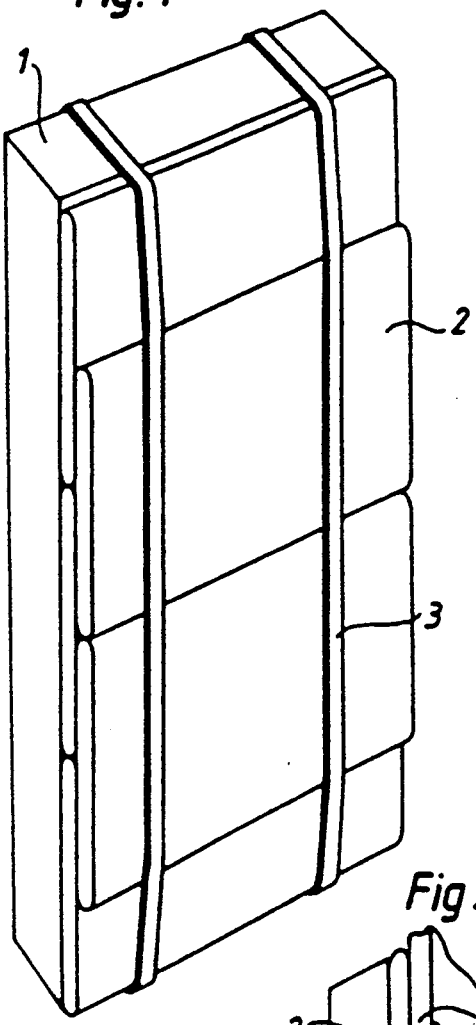
FIG. 1 is a perspective view of an isolation element according to the invention.
Figure 2:
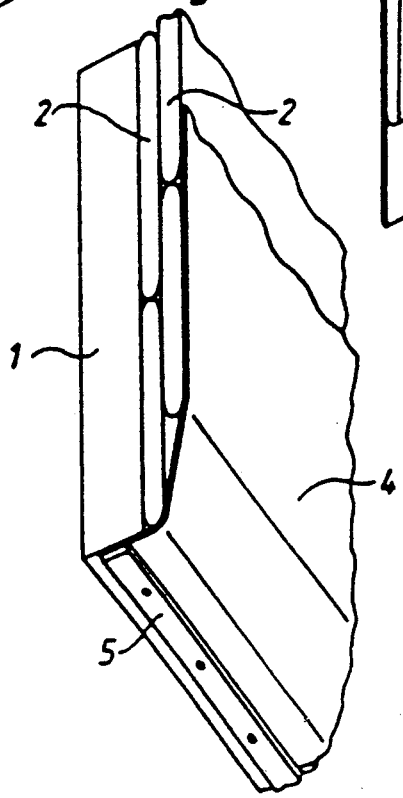
FIG. 2 is a perspective view of a part of an isolation element according to the invention.

The implementation of the isolation element is shown in FIG. 1. The isolation element comprises an essentially rectangular, plate-shaped block 1. On one of the two sides of the block 1, two layers of cushion-shaped bodies 2 are attached. As can be seen from the figure, the two layers of the cushion-shaped bodies 2 are placed in a displaced relationship to each other, i.e. overlapping each other, with the aim to avoid vibration or heat bridges which are created by the edges of the cushion-shaped bodies 2. The cushion-shaped bodies 2 can be of any size within the lateral surface boundaries of the plate-shaped block 1 but the cushion-shaped bodies 2 are preferably rectangular with a length corresponding approximately to the length of the block 1, i.e. the lengths the side surfaces of the block 1. If several blocks are placed side by side it may be appropriate to give the cushion-shaped bodies 2 such length that they can bridge joints between the block elements. The cushion-shaped bodies 2 are attached to the block 1 with straps 3 made of plastic or equivalent and extending around the block 1 and the cushion-shaped bodies 2. The cushions can also be attached with the aid of a sheet 4 of plastic or equivalent as is shown in FIG. 2, which in turn is attached to the lower edge of the block 1 with the aid of an attachment bar 5. In this way, the buoyancy forces acting at the cushion-shaped bodies during the installation phase are also counter-acted without the need of straps 3. The sheet 4 can also be attached to the upper edge of the block 1 in a similar way.

Figure 3:
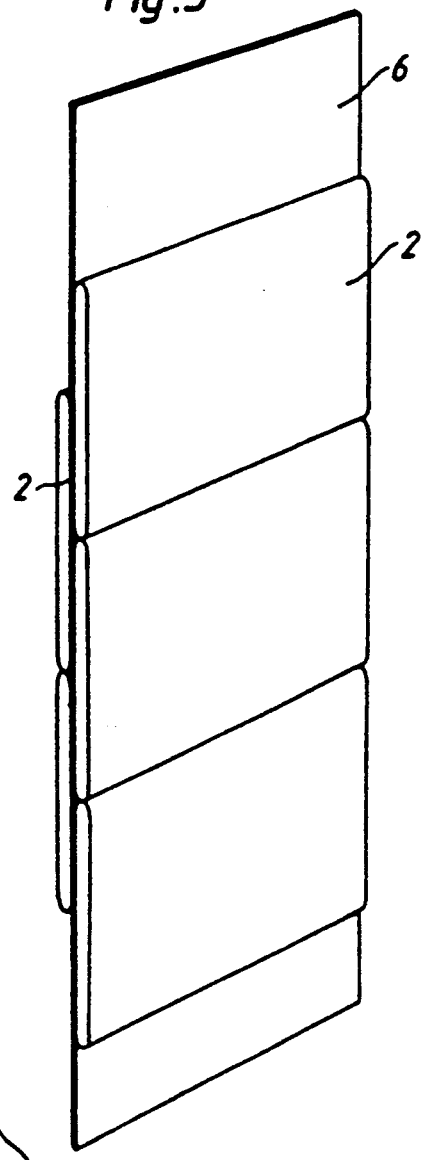
FIG. 3 is a perspective view at an alternative arrangement for the attachment of the cushion-shaped bodies to each other.

As shown in FIG. 3, it is also possible to arrange the cushion-shaped bodies 2 in two layers on both sides of a sheet. The cushion-shaped bodies 2 are also in this case preferably arranged with displacement (in the perpendicular direction of the block 1) in such a way that joints between cushion-shaped bodies 2 in one layer preferably are located between the joints of the cushion-shaped bodies 2 in the other layer.

Figure 4A:
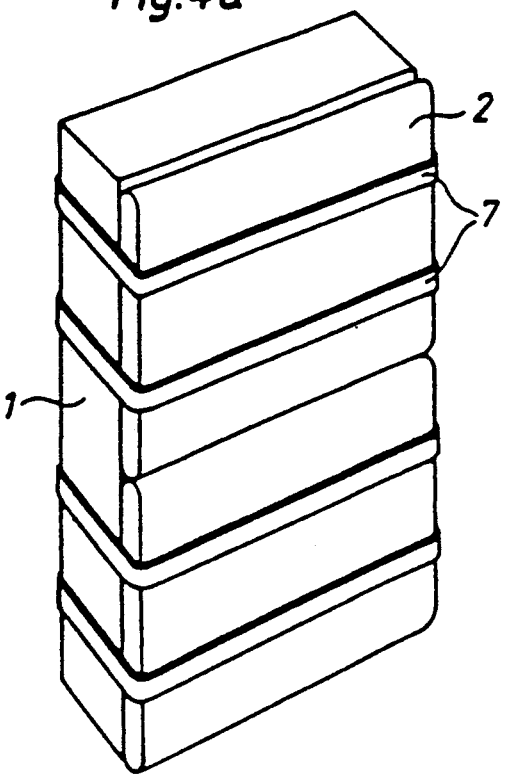
FIGS. 4*a* and 4*b* are perspective views of isolation elements according to the invention with horizontal and vertical pre-stressing strips, respectively.
Figure 4B:
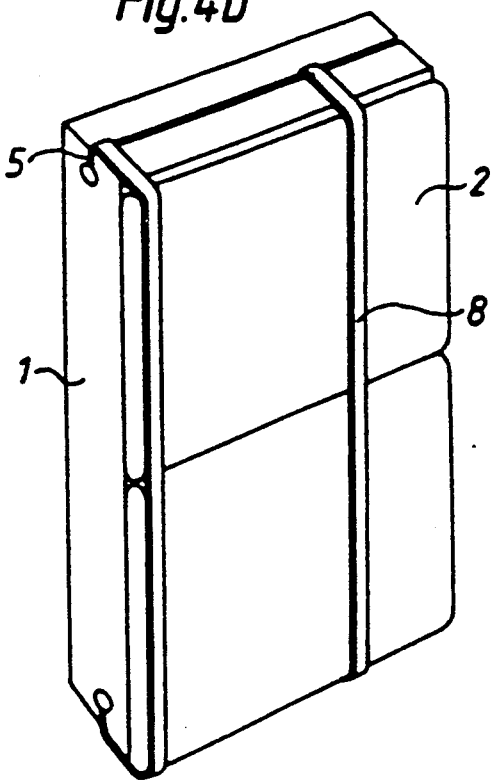

Whether the individual cushion-shaped bodies 2 are attached to the block 1 edge to edge or they are connected in one or several layers with some kind of sheet 2, they can also be fixed to the block 1 with pre-stressing straps 7 running in the lateral direction of the block as shown in FIG. 4*a*, or with straps 8 running in the vertical direction of the block 1, as shown in FIG. 4*b*. The pre-stressing straps 7, 8 make it possible to increase, by tightening their tension, the pressure in the cushion-shaped bodies 2 a desirable point of the installation phase.

Figure 5:
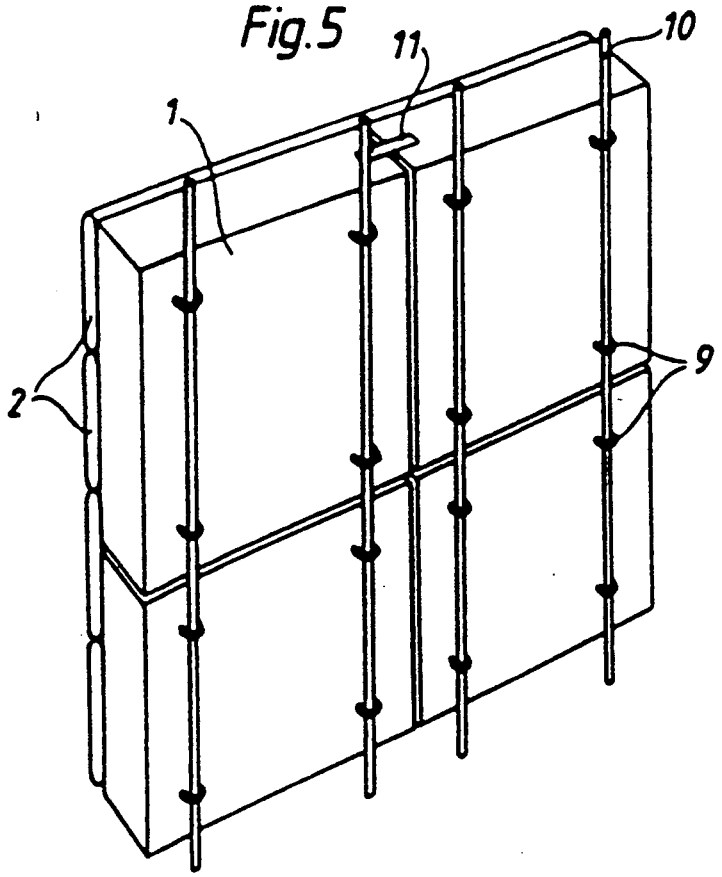
FIG. 5 is a perspective view of a part of an isolation arrangement, composed of isolation elements according to FIG. 3.

Turning now to FIG. 5, the rectangular, plate-shaped block is provided with guiding arrangements on the side surface without cushion. They are preferably archwise loop-like or hook-like attachment elements 9, extending from the block 1 which are interacting with the rods 10, as will be discussed below. Each block 1 suitably contains four or more such attachments elements 9 which are placed in a rectangular pattern with the openings facing the edges of the long sides of the block 1. The attachments elements 9 are preferably placed at such a distance from each other that the side length of the rectangular pattern corresponds to half the side length of the isolation elements. The rectangular plate-shaped block has a coupling arrangements 11 at the end of the edge surfaces of its long side to allow for coupling to an adjoining block.

Figure 6:
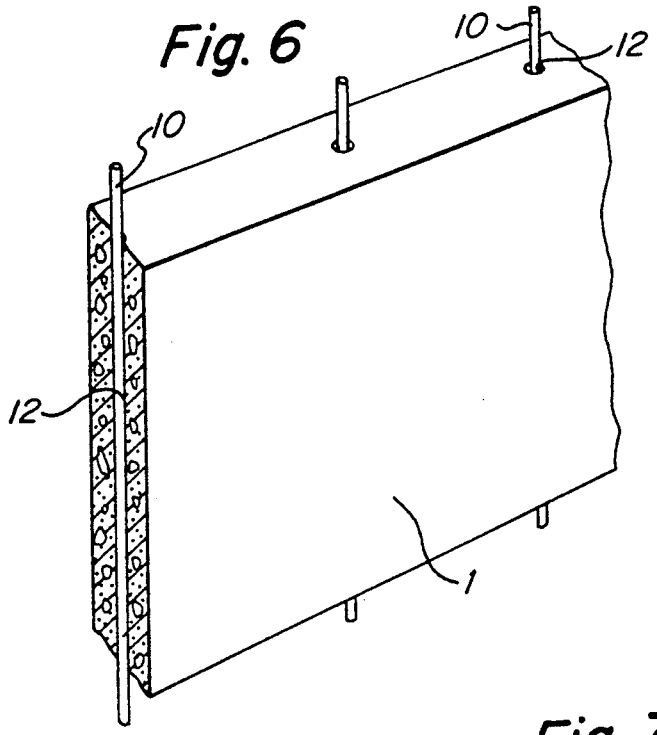
FIG. 6 is a perspective view of a block, which forms part of the isolation element according to the invention, broken away to reveal internal structure

The guiding arrangements can, as is shown in FIG. 6, also have the form of circular channels 12, passing through the block 1 into which the guiding rods 10 can be introduced. Each block 1 suitably contains at least two channels 12 which are arranged perpendicular to the longitudinal direction of the blocks 1. The embodiment with continuous channels 12 makes it possible to use both side surfaces of the block 1 for the attachment of cushion-shaped bodies 2. In order to achieve the channels 12 in a simple way, it is possible to use prefabricated concrete elements with the channels 12 therein.

The plate-shaped block 1 is, as described above, suitably manufactured from a material with high density such as concrete, iron or steel. The cushion-shaped bodies 2 can be void and manufactured of a sheet material, preferably of plastic. The hollow cushion-shaped bodies can be filled with gas, such as air, liquid or foam. Alternatively, the cushion-shaped bodies 2 can be made of a material with low density, such as styrofoam, cellular plastic, etc.

Figure 7:
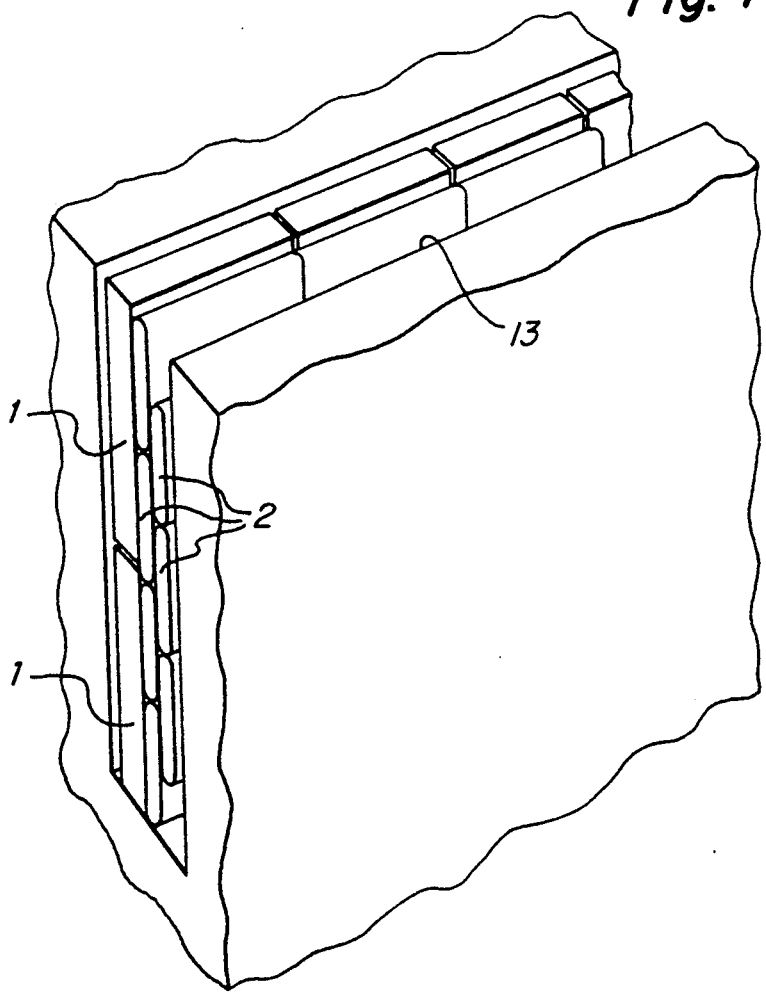
FIG. 7 is a perspective view of an isolation arrangement in the ground according to the invention.
Figure 8A:
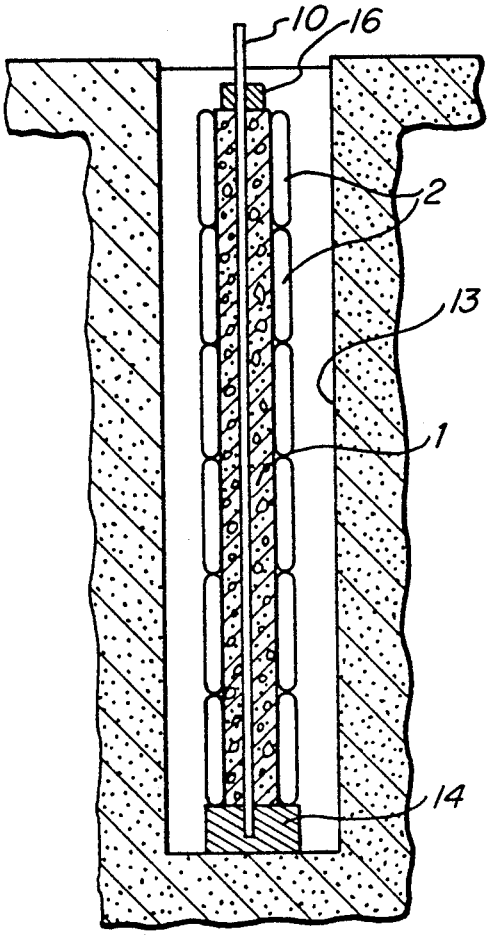
FIG. 8*a* is a cross-section view of an isolation arrangement according to the invention.
Figure 8B:
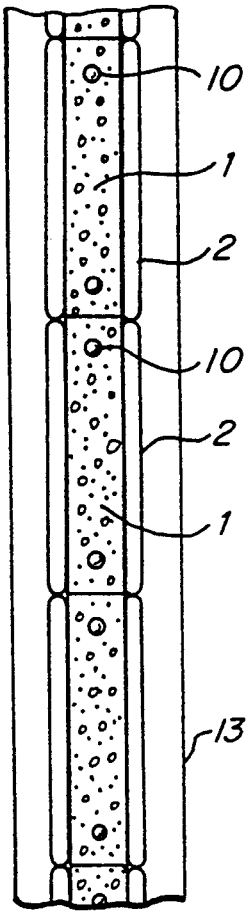
FIG. 8*b* is a top plan view of the isolation arrangement of FIG. 8*a*.

The invention also concerns the use of isolation elements according to the above in an isolation arrangement for the isolation of vibrations and/or heat preferably in the ground. The basic composition of the isolation arrangement is shown in FIGS. 7 and 8. The isolation arrangement comprises an excavated trench 13 in the ground. In the trench are placed preferably vertical guide rods 10 of iron or similar. The guide rods 10 are arranged in a row and anchored into a steel or concrete beam 14, located at the bottom of the trench 13. The whole isolation installation arrangement is composed of a number of blocks 1 comprising guiding channels 12 according to FIG. 6, whereby the blocks 1 are threaded on to the guide rods 10 and stacked from the bottom of the trench 13 to the orifice and preferably continuously in the longitudinal direction of the trench 13 one on top of the other and/or next to each other placed on their sides. As the blocks consist partially of very stiff material, they can take high static or dynamic forces, e.g. high earth pressures from adjacent buildings, railway lines, heavy machines, etc. The isolation arrangement also comprises a suitable stabilizing material, which is poured into the trench 13 before the placement of the isolation cushion-shaped bodies 2. The isolation elements which are placed one on top of the other can be tied together with the aid of prestressing tool 16, see FIG. 8*a*.

Figure 9:
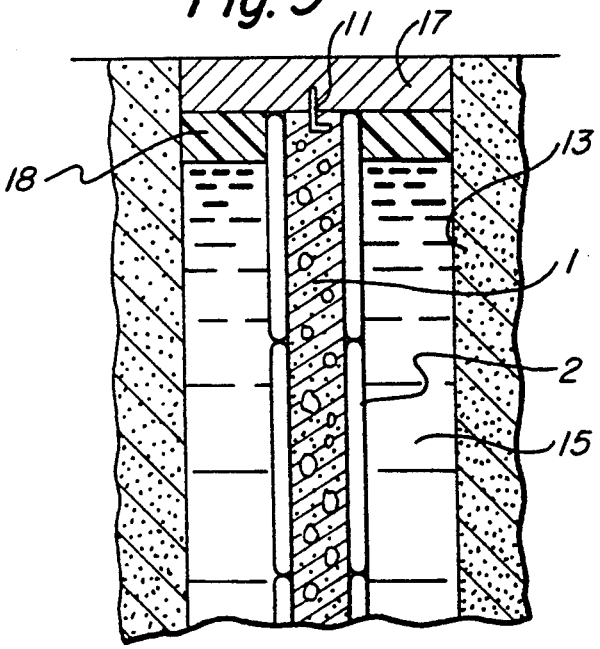
FIG. 9 is a cross-sectional view of the cover of the isolation wall in the surface of the ground according to the invention.

Referring to FIG. 9, when the isolation arrangement is to be located in a road bed, the isolation wall can be provided with a lid-like arrangement. This can consist of a plater or a beam 17 resting at the top element and covering the width of the trench at the level of the road surface.

In connection with the installation of an isolation arrangement as described above, the installation can be facilitated if the distance between adjacent guide rods 10 approximately corresponds to about half the length of the isolation elements, provided that also the respective guide arrangements 9 or channels 12 are placed at this distance with respect to each other. In this way, a constant distance is achieved between all adjacent guide rods, which facilitates the completion of the construction work. The isolation arrangement can also include joining elements 11, as discussed above, between the isolation elements at the top. Below the beam 17, an isolation block 18 can be placed in order to achieve insulation against for example frost action.

The stabilizing liquid can consist of water, a suspension of water and bentonite, polymers, water and cement/bentonite or other tixotropic materials as well as suitable chemical additives.

The conception of the isolation elements and the construction of the isolation arrangement results in significant advantages compared to previously known arrangements. The isolation elements can be manufactured relatively cheaply. They can easily be made effective as a result of the cushion-shaped bodies which can be placed in several layers one on top of the other with displacement. No sophisticated manufacturing methods are required. The cushion-shaped bodies can be manufactured for example by pressure extrusion, a method which is widely used for example for the manufacturing of plastic bags for coffee packaging, etc. The cushion-shaped bodies can, when they are manufactured of plastic sheet material be attached to one another or to an eventual plastic sheet material holding the layer together by simple welding of the plastic material. The sheet material can in turn be attached to the block in a variety of well-known ways.

The amount of plastic material used is relatively low. The installation of the isolation elements in connection with the implementation of the isolation arrangement offers significant simplifications compared to previously known methods and thus reduces the cost. Because the blocks are heavy and balance the buoyancy forces resulting from the insertion of the gas-filled cushion-shaped bodies into the slurry-filled trench, no stabilizing weight is required at the bottom of the trench. Therefore, the trench does not have to be excavated as deeply as before and the installation of the isolation elements in the trench is facilitated significantly. The precision is also very high because of the interaction between the guiding rods and the guiding arrangement. This results in a high quality of execution of the finished isolation arrangement. The vibration-damping effect is also very high because of the intimate combination of heavy stiff plate and flexible cushions. The abrupt change of impedance results from the fact that the vibrations must pass through a layer plate/cushion with an unusually high drop of density.

Isolation elements can to advantage be used in the case of vibration problems in water, because the elements can be made negatively buoyant. Specially in the case of deep trenches it may be preferable to replace the guiding arrangement 9, which have the form of loops attached to the side of the block, by continuous tubes, thus creating rim guiding channels.

The invention is not limited to the embodiments shown above but can be varied within the framework of the following patent claims.

I claim:

1. Isolation element for isolation of vibrations and thermal energy comprising:

a plate-shaped block manufactured of a high density material and having side surfaces;

guiding means connected with the block for connecting the block to guide rods;

several cushion-shaped bodies manufactured of a low density material attached edge to edge to each other thereby forming joints therebetween and attached to at least one of the side surfaces of the block, the cushion-shaped bodies on the at least one of the side surfaces of the block being attached in first and second layers to the block, the first layer being located along the block with a lateral displacement relative to the second layer so joints formed between the cushion-shaped bodies in the first layer are located midway between joints formed between the cushion-shaped bodies of the second layer.

2. Isolation element according to claim 1, wherein the cushion-shaped bodies are of rectangular shape with a length approximately equal to that of the side surfaces of the block and a width smaller than that of the side surfaces of the block.

3. Isolation element according to claim 1, further comprising straps which attach the cushion-shaped bodies to the block, the straps passing around the block and the cushion-shaped bodies.

4. Isolation element according to claim 1, wherein the cushion-shaped bodies are attached to a sheet of material, which in turn is attached to the block.

5. Isolation element according to claim 4, wherein the cushion-shaped bodies in the first layer are attached to one side of the sheet of material and the cushion-shaped bodies in the second layer are attached to the other side of the sheet of material with the lateral displacement, the sheet of material being attached in turn to the block.

6. Isolation element according to claim 1, wherein the guiding means are arched attachment elements extending from the block.

7. Isolation element according to claim 6, wherein the arched attachment elements are at least four attachment elements placed in a rectangular pattern with openings of the attachment elements facing in one direction.

8. Isolation element according to claim 7, wherein a long side of the rectangular pattern has a length which corresponds to half a length of a long side of the block.

9. Isolation element according to claim 1, further comprising a coupling arrangement on the block for coupling the block to adjacent blocks.

10. Isolation element according to claim 1, wherein the cushion-shaped bodies are hollow and manufactured from a sheet of material.

11. Isolation element according to claim 10, wherein the sheet of material is a plastic material.

12. Isolation element according to claim 10, wherein the cushion-shaped bodies are filled with a material chosen from a group consisting of gas, liquid and foam.

13. Isolation element according to claim 1, wherein the low density material is a plastic material.

14. Isolation element according to claim 13, wherein the plastic material is styrofoam.

15. Isolation element according to claim 1, wherein the high density material of the plate-shaped block is chosen from a group consisting of concrete, iron and steel.

16. Isolation arrangement for isolation of vibration and thermal energy, comprising:

(a) anchoring means;

(b) a plurality of parallel guide rods placed in a row extending from the anchoring means; and (c) at least one isolation element, each isolation element comprising:

(i) a plate-shaped block manufactured of a high density material and having side surfaces;

(ii) guide means connecting the block to at least two of the plurality of parallel guide rods;

(iii) several cushion-shaped bodies manufactured of a low density material attached edge to edge to each other thereby forming joints therebetween and attached to at least one of the side surfaces of the block, the cushion-shaped bodies on the at least one of the side surfaces of the block being attached in first and second layers to the block, the first layer being located along the block with a lateral displacement relative to the second layer so joints formed between the cushion-shaped bodies in the first layer are located midway between joints formed between the cushion-shaped bodies of the second layer.

17. Isolation arrangement according to claim 16, wherein the anchoring means being located in a bottom portion of a trench formed in soil, the guide rods extending from the anchoring means at the bottom portion of the trench toward a top orifice thereof.

18. Isolation arrangement according to claim 17, further comprising a stabilizing material in the trench.

19. Isolation arrangement according to claim 18, wherein the stabilizing material is chosen from a group consisting of water; a suspension of water and bentonite; a suspension of water, bentonite and a polymer; a suspension of water and a polymer; water and cement/bentonite; and water and any tixotropic material.

20. Isolation arrangement according to claim 16, wherein the at least one isolation element includes a coupling arrangement for coupling to adjacent isolation elements.

21. Isolation arrangement according to claim 19, wherein adjacent ones of the plurality of guide rods are spaced half the length of the isolation element from each other.

* * * * *

UNITED STATES PATENT AND TRADEMARK OFFICE

CERTIFICATE OF CORRECTION

PATENT NO. : 5,295,337

DATED : March 22, 1994

INVENTOR(S) : Karl R. Massarsch

It is certified that error appears in the above-identified patent and that said Letters Patent is hereby corrected as shown below:

On the title page: Item [56]

Under Foreign Patent Documents, "4/1986" should be --6/1986--;
Col. 1, line 29, "430,620" should be --430.620--;
Col. 1, line 34, "." should be --,--;
Col. 1, line 52, "SE, B." should be --SE, B,--;
Col. 1, line 61, "p" should be --a--;
Col. 3, line 48, "the figure" should be --FIG. 1--;
Col. 3, line 58, after "blocks", insert --1--;

Col. 3, line 65, "cushions" should be --cushion-shaped bodies 2--;
Col. 4, line 1, after "bodies", insert --2--;
Col. 4, line 7, after "sheet", insert --6--;
Col. 4, line 17, after "block", insert --,--;
Col. 4, line 22, "a" should be --at--;
Col. 4, line 26, "cushion" should be --cushions--;
Col. 4, line 54 "void and manufactured of" should be --hollow and manufactured from--;
Col. 4, line 66, after "trench", insert --13--;
Col. 5, line 20, "wall" should be --arrangement--;
Col. 5, line 22, "plater" should be --plate--.

Signed and Sealed this

Sixth Day of September, 1994

*Attest:*

*Attesting Officer*

Bruce Lehman

BRUCE LEHMAN

*Commissioner of Patents and Trademarks*